US009172168B2

(12) United States Patent
Ebisawa

(10) Patent No.: US 9,172,168 B2
(45) Date of Patent: Oct. 27, 2015

(54) CONNECTOR, CONNECTOR DEVICE, AND BATTERY UNIT

(75) Inventor: Takeshi Ebisawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 132 days.

(21) Appl. No.: 14/111,493

(22) PCT Filed: Nov. 14, 2011

(86) PCT No.: PCT/JP2011/076164
§ 371 (c)(1),
(2), (4) Date: Oct. 11, 2013

(87) PCT Pub. No.: WO2013/001671
PCT Pub. Date: Jan. 3, 2013

(65) Prior Publication Data

US 2014/0080339 A1 Mar. 20, 2014

(30) Foreign Application Priority Data

Jun. 27, 2011 (JP) ..... 2011-141457

(51) Int. Cl.

| | |
|---|---|
| ***H01R 13/64*** | (2006.01) |
| ***H01R 13/04*** | (2006.01) |
| ***H01R 13/631*** | (2006.01) |
| ***H01R 13/514*** | (2006.01) |
| *H01R 4/40* | (2006.01) |
| *H01R 4/48* | (2006.01) |
| *H01R 13/15* | (2006.01) |

(52) U.S. Cl.
CPC ..... *H01R 13/04* (2013.01); *H01R 13/514* (2013.01); *H01R 13/6315* (2013.01); *H01R 4/40* (2013.01); *H01R 4/4863* (2013.01); *H01R 13/15* (2013.01)

(58) Field of Classification Search
CPC ..... H01R 13/6315
USPC ..... 439/248, 247
See application file for complete search history.

(56) References Cited

U.S. PATENT DOCUMENTS

| | | | | |
|---|---|---|---|---|
| 4,878,862 | A | 11/1989 | Wise | |
| 5,931,688 | A * | 8/1999 | Hasz et al. | 439/247 |
| 8,177,587 | B2 * | 5/2012 | Takagi et al. | 439/733.1 |

(Continued)

FOREIGN PATENT DOCUMENTS

| | | |
|---|---|---|
| JP | S62-131333 | 8/1987 |
| JP | H01-081883 | 5/1989 |
| JP | 2003-346940 A | 12/2003 |

(Continued)

OTHER PUBLICATIONS

International Search Report of PCT/JP2011/076164, Feb. 7, 2012.
European Search Report dated Sep. 23, 2014 in European Application No. 11868842.3.

*Primary Examiner* — Phuong Dinh
(74) *Attorney, Agent, or Firm* — Collard & Roe, P.C.

(57) ABSTRACT

A connector is provided with a first housing, a second housing attached to the first housing and forming a contact receiving portion jointly with the first housing, and a contact at least partially received in the contact receiving portion. The second housing is attached to the first housing so as to be movable in a predetermined direction relative to the first housing. The contact is received in the contact receiving portion in a state where the contact is not fixed to the first housing or the second housing so as to be movable relative to the first housing and the second housing.

18 Claims, 15 Drawing Sheets

(56) References Cited

U.S. PATENT DOCUMENTS

| | | | |
|---|---|---|---|
| 2008/0194130 | A1 | 8/2008 | Kimura |
| 2009/0186495 | A1 | 7/2009 | Taylor |
| 2011/0065331 | A1 | 3/2011 | Takagi et al. |

FOREIGN PATENT DOCUMENTS

| | | | |
|---|---|---|---|
| JP | 2008-198441 | A | 8/2008 |
| JP | 2009-218063 | A | 9/2009 |
| JP | 2011-60732 | A | 3/2011 |

* cited by examiner

CONNECTOR, CONNECTOR DEVICE, AND BATTERY UNIT

CROSS REFERENCE TO RELATED APPLICATIONS

This application is the National Stage of PCT/JP2011/076164 filed on Nov. 14, 2011, which claims priority under 35 U.S.C. §119 of Japanese Application No. 2011-141457 filed on Jun. 27, 2011, the disclosures of which are incorporated by reference. The international application under PCT article 21(2) was not published in English.

TECHNICAL FIELD

This invention relates to a connector, a connector device, and a battery unit and, in particular, relates to a connector, a connector device, and a battery unit which has a function of correcting the position offset with respect to a connection object.

BACKGROUND ART

Conventionally, as a connector having a function of correcting the position offset with respect to a connection object, there is known, as shown in FIG. 15, a plug-in connector (male) 100 comprising a terminal block body 120 attached to a panel 110, a conductive connection wiring board 130 attached to the terminal block body 120, a male pin receiving nut 140 incorporated in the terminal block body 120, a male pin 150 attached to the terminal block body 120 through the male pin receiving nut 140, and a plug-in connector housing 160 attached to the terminal block body 120 through the male pin 150 (see, e.g. Patent Document 1).

In the plug-in connector (male) 100 described in Patent Document 1, the floating function required for plug-in connection between the plug-in connector (male) 100 and a plug-in connector (female) 170 is achieved by attaching the male pin 150 and the male pin receiving nut 140 to the terminal block body 120 with some play therebetween.

PRIOR ART DOCUMENT

Patent Document

Patent Document 1: JP-A-2003-346940

SUMMARY OF THE INVENTION

Problem to be Solved by the Invention

However, in the conventional plug-in connector (male) 100, there has been a problem that while the floatability is achieved by positively providing the attaching play between the members, if this attaching play is too large, the attaching strength of the members is impaired and therefore the magnitude of the attaching play should be limited to a certain degree, resulting in that the floating amount (the displacement amount of the male pin 150) that can be achieved is limited.

Further, in the conventional plug-in connector (male) 100, there has been a problem that since the male pin 150 is attached to the terminal block body 120 through the male pin receiving nut 140 as an attaching member, the number of components is large and thus the workload for assembly is also large.

Therefore, this invention aims to solve the conventional problems, that is, it is an object of this invention to provide a connector, a connector device, and a battery unit which ensure a large floating amount of a contact with a simple structure and further which are small in the number of components to thereby reduce the workload for assembly.

Means for Solving the Problem

A connector according to this invention comprises a first housing, a second housing attached to the first housing and forming a contact receiving portion jointly with the first housing, and a contact at least partially received in the contact receiving portion, wherein the second housing is attached to the first housing so as to be movable in a predetermined direction relative to the first housing, and wherein the contact is received in the contact receiving portion in a state where the contact is not fixed to the first housing or the second housing so as to be movable relative to the first housing and the second housing, whereby solving the above-mentioned problem.

The contact may comprise a second contact portion disposed on the second housing side and adapted to contact with a connection object.

The contact may further comprise a first contact portion disposed on the first housing side and adapted to contact with another connection object.

The second housing may comprise a second control portion that controls a position and posture of the contact in the contact receiving portion and that pushes the contact when the first housing and the second housing move relative to each other.

The first housing may comprise a first control portion that controls a position and posture of the contact in the contact receiving portion and that pushes the contact when the first housing and the second housing move relative to each other.

The contact may comprise a pair of conductive members facing each other and a biasing member provided between the pair of conductive members and biasing the pair of conductive members in a direction of causing them to approach each other, and wherein the contact may be adapted to hold the connection object between the pair of conductive members biased by the biasing member.

The second control portion of the second housing may be interposed between the pair of conductive members.

The contact may comprise a pair of conductive members facing each other and a biasing member provided between the pair of conductive members and biasing the pair of conductive members in a direction of causing them to approach each other, and wherein the contact bay be adapted to hold the another connection object between the pair of conductive members biased by the biasing member.

The first control portion of the first housing may be interposed between the pair of conductive members.

The second housing may comprise a second position restricting portion that restricts a position of the contact in a direction perpendicular to a direction of fitting to the connection object and to a direction in which the first housing relatively moves.

The first housing may comprise a first position restricting portion that restricts a position of the contact in a direction perpendicular to a direction of fitting to the connection object and to a direction in which the second housing relatively moves.

The second housing may be attached to the first housing so as to be movable relative to the first housing in a direction perpendicular to a direction of fitting to the connection object.

A connector device according to this invention comprises the connector and an attaching object to which the connector is attached, wherein the first housing is attached to the attaching object so as to be movable relative to the attaching object, whereby solving the above-mentioned problem.

A battery unit according to this invention comprises the connector according to any one of claims 1 to 12, an attaching object to which the connector is attached, and the connection object, wherein the connection object is a bus bar, whereby solving the above-mentioned problem.

The battery unit may further comprise another bus bar, wherein the bus bar may be connected to the other bus bar and to the contact of the connector.

The bus bar may comprise a bent shape.

Effect of the Invention

According to this invention, it is possible to ensure a large floating amount (displacement amount) of a contact with a simple structure and thus to improve the reliability of connection to a connection object.

Further, since no additional component, such as an attaching member, is required for attaching a contact to a housing, the number of components is small and thus the workload for assembly can be reduced.

MODE FOR CARRYING OUT THE INVENTION

Hereinbelow, a connector as one embodiment of this invention will be described with reference to the drawings.

In the following description, a direction in which a bus bar (connection object) and a rack-side contact (another connection object) are each caused to approach and fitted to a connector is defined as a first direction X, a direction in which a second housing is caused to slide relative to a first housing is defined as a second direction Y, and a direction perpendicular to the first direction X and the second direction Y is defined as a third direction Z. In the following embodiment, a description will be given assuming that the second direction Y is perpendicular to the first direction X. However, it may be configured such that the second direction Y is not perpendicular to the first direction X. Further, in the following embodiment, a description will be given assuming that the fitting direction of the bus bar relative to the connector and the fitting direction of the rack-side contact relative to the connector are set to be parallel to each other. However, they may be set non-parallel to each other.

Embodiment

Figure 1:
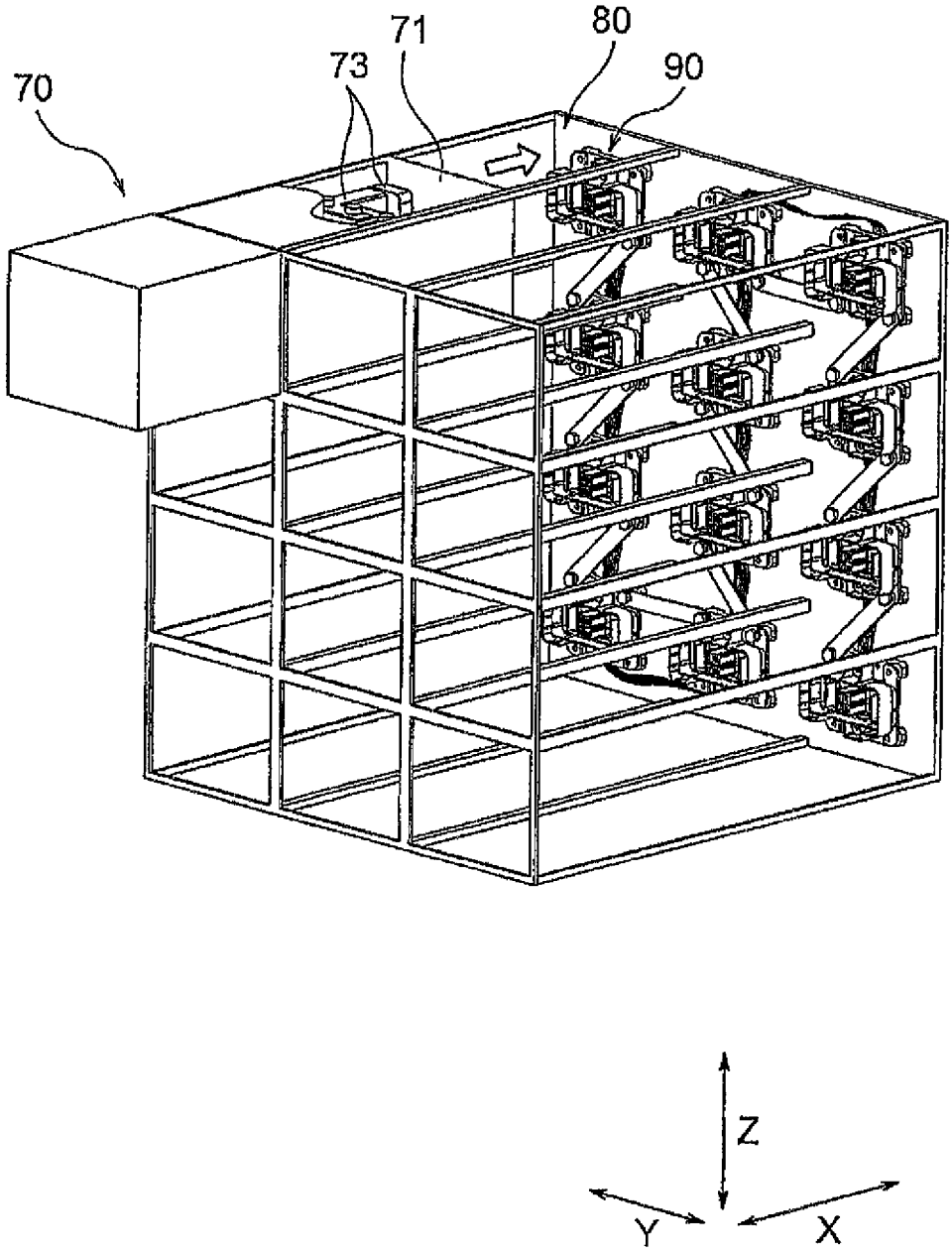
FIG. 1 is a diagram showing the manner of using a connector as one embodiment of this invention.
Figure 2:
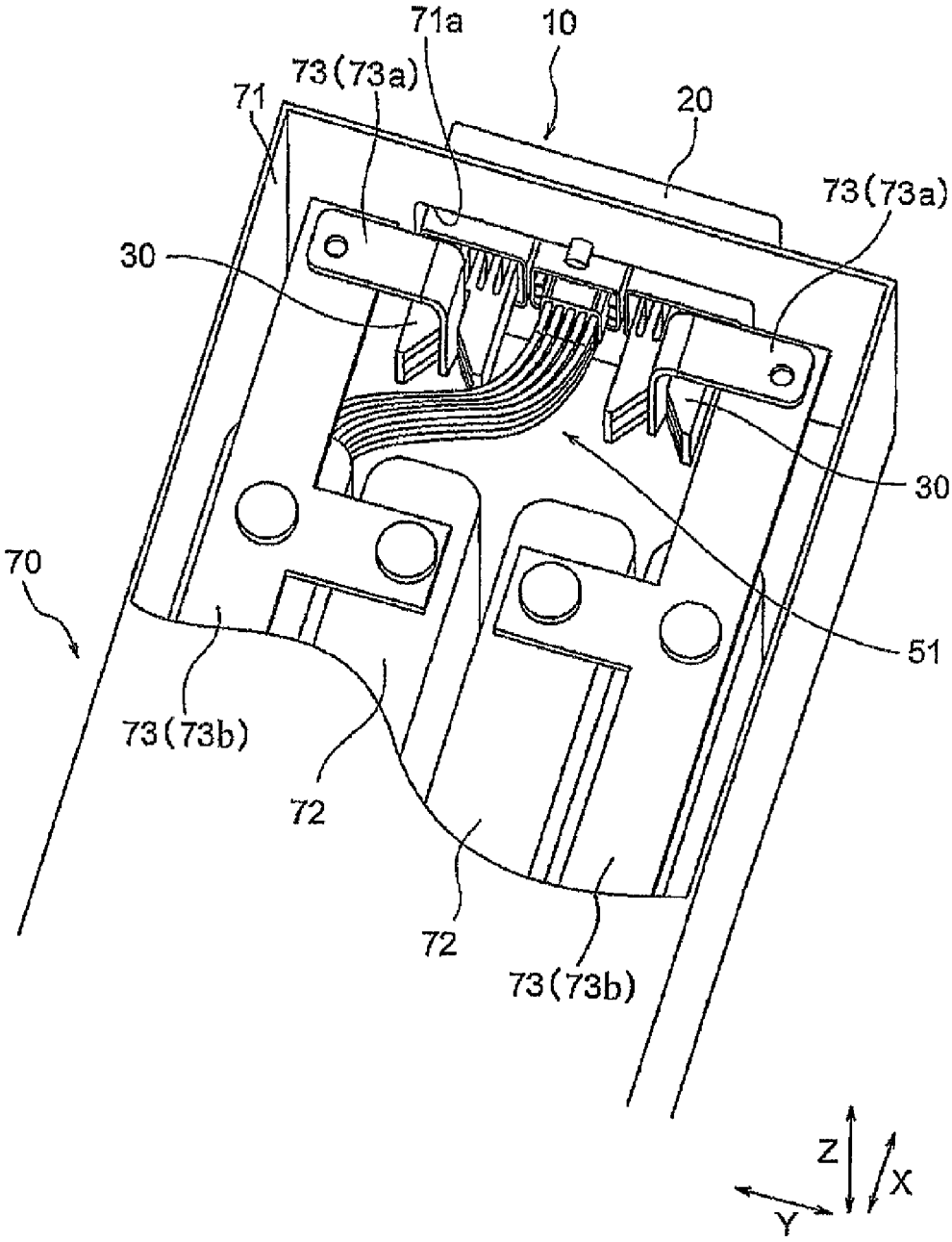
FIG. 2 is an explanatory diagram showing a battery unit attached with the connector.

A connector 10 of this embodiment is a connector for a secondary battery. As shown in FIGS. 1 to 5, the connector 10 is attached to a casing (attaching object) 71 of a battery unit 70 incorporating batteries (secondary batteries) 72 and, when the battery unit 70 is inserted into a receiving rack 80, the connector 10 is fitted to a rack-side connector 90 attached to the receiving rack 80, thereby establishing electrical connection between bus bars 73 incorporated in the battery unit 70 and connected to the batteries 72 and rack-side contacts 91 provided in the rack-side connector 90. Symbol 51 shown in FIG. 2 denotes signal lines which are connected to later-described signal contacts (not illustrated). As shown in FIG. 2, each bus bar 73 comprises a bus bar 73*b* connected to the batteries 72 and a bus bar 73*a* having one end connected to the bus bar 73*b* and the other end connected to contacts 40 of the connector 10. The bus bar 73*a* has a bent L-shape.

As shown in FIGS. 4 to 11, the connector 10 comprises a first housing 20, second housings 30 each attached to the first housing 20 so as to be slidable in the second direction Y relative to the first housing 20, the contacts 40 for power supply received in contact receiving portions 60 each formed by the first housing 20 and the second housing 30, and a signal housing 50 attached to the first housing 20 and holding the signal contacts (not illustrated).

Figure 3:
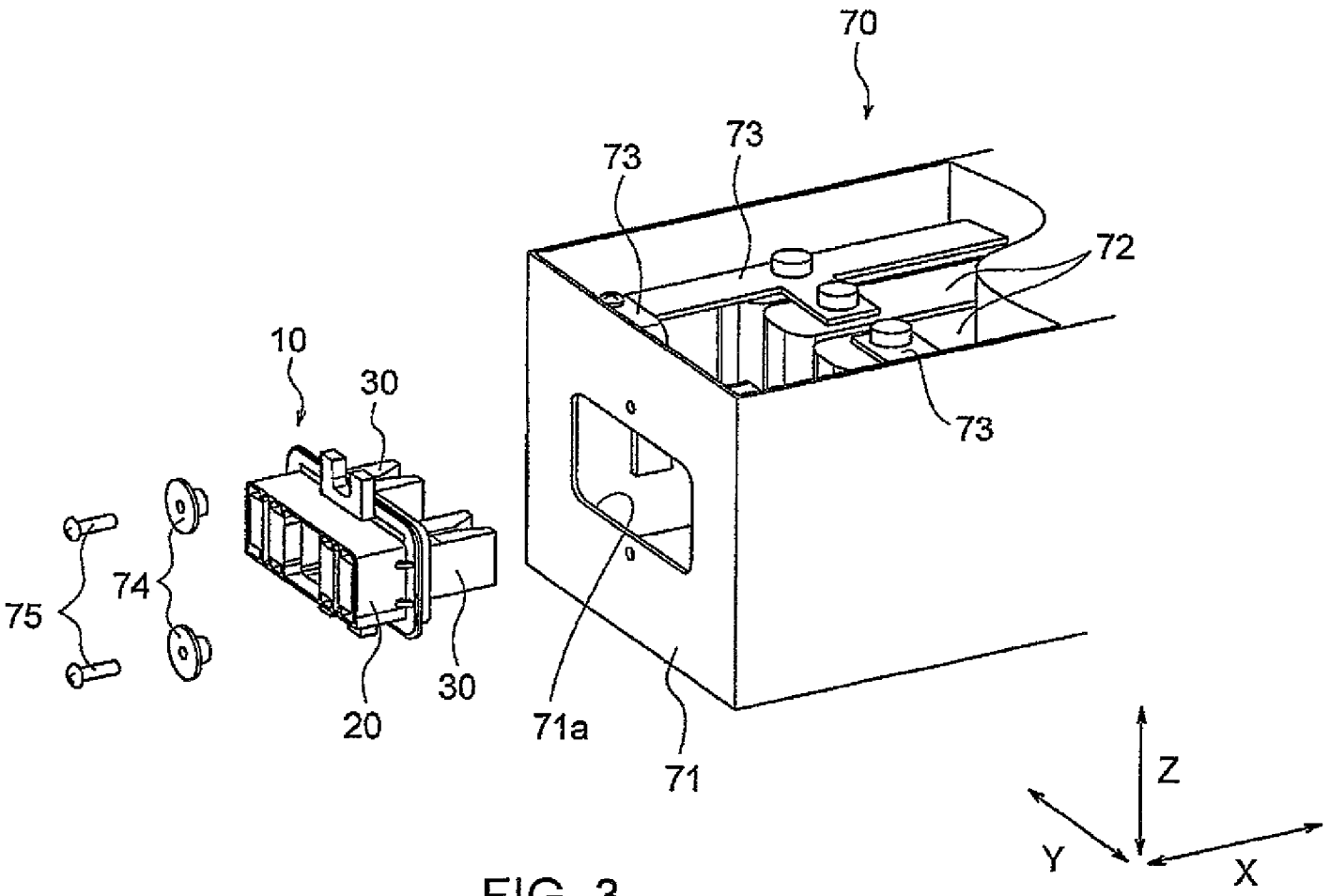
FIG. 3 is an explanatory diagram for explaining a method of attaching the connector to the battery unit.

The first housing 20 is formed of an insulating resin. As shown in FIG. 3, the first housing 20 is attached to the casing 71 of the battery unit 70 using spacers 74 and bolts 75 in the state where the first housing 20 has play (clearance) in the second direction Y and the third direction Z with respect to an attaching opening 71*a* formed in the casing 71 so as to be movable in the second direction Y and the third direction Z relative to the casing 71.

As shown in FIGS. 6 to 11, the first housing 20 integrally has first receiving portions 21 each receiving part of the contacts 40, first openings 22 each for allowing insertion of the rack-side contact 91 into the first receiving portion 21, slide guide portions 23 supporting later-described attaching spring portions 33 of each second housing 30 in the state where the attaching spring portions 33 are slidable in the second direction Y, first control portions 24 each controlling the position and posture of the contacts 40 in the contact receiving portion 60, first position restricting portions 25 each restricting the position of the contacts 40 in the third direction Z, and a signal housing holding portion 26 holding the signal housing 50.

Figure 6:
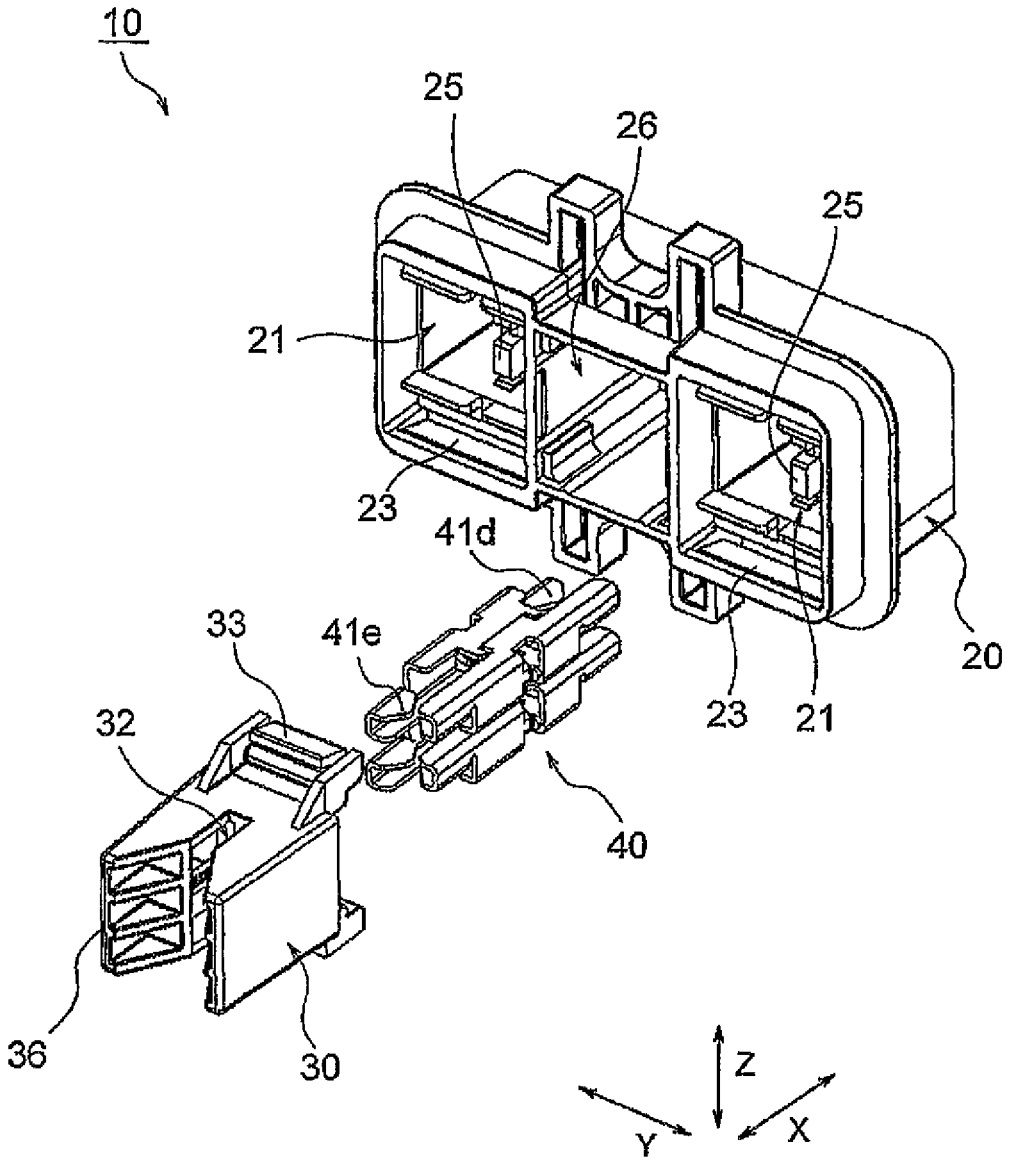
FIG. 6 is an exploded perspective view showing the connector.
Figure 7:
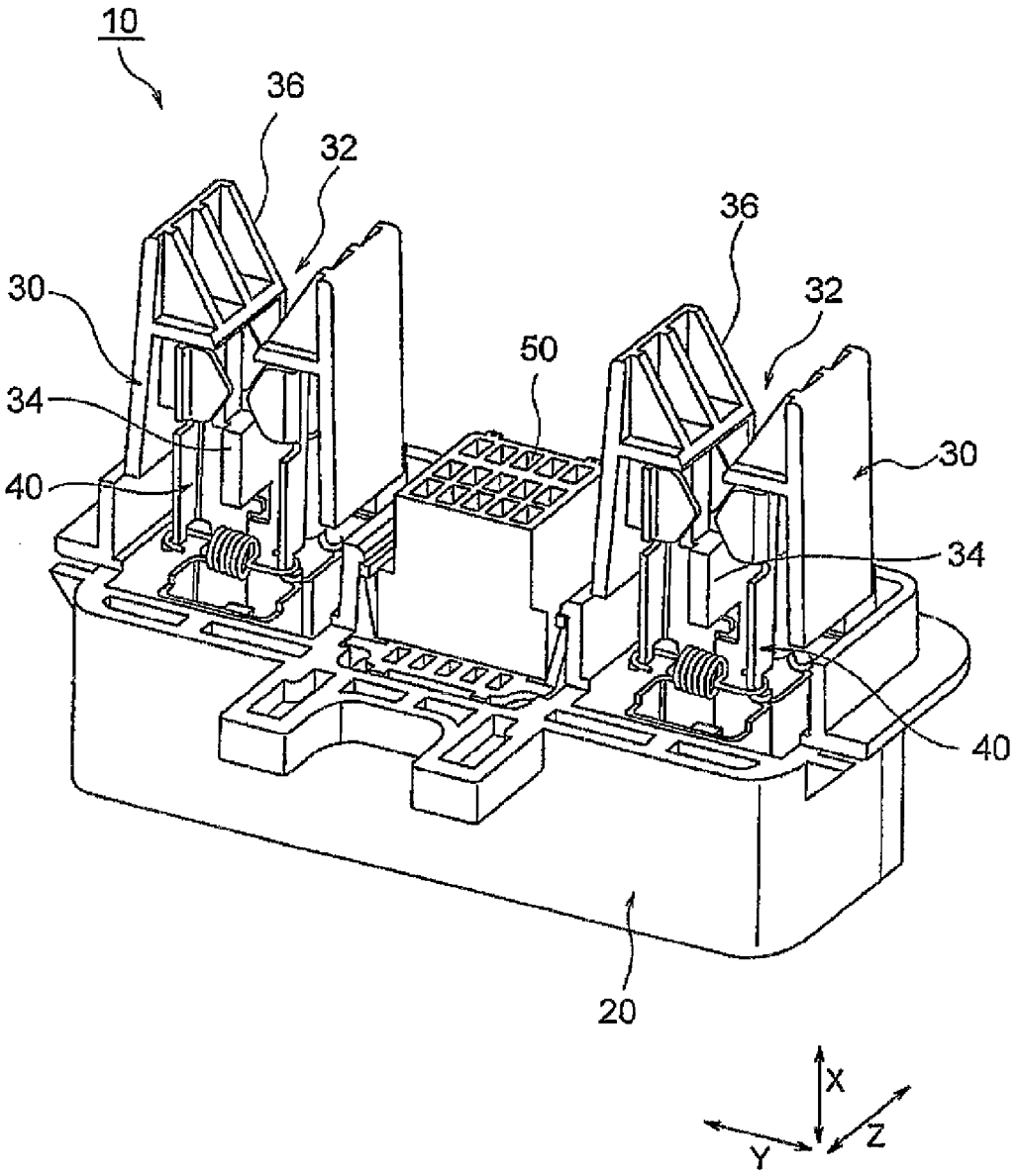
FIG. 7 is an overall perspective view showing the connector.
Figure 8:
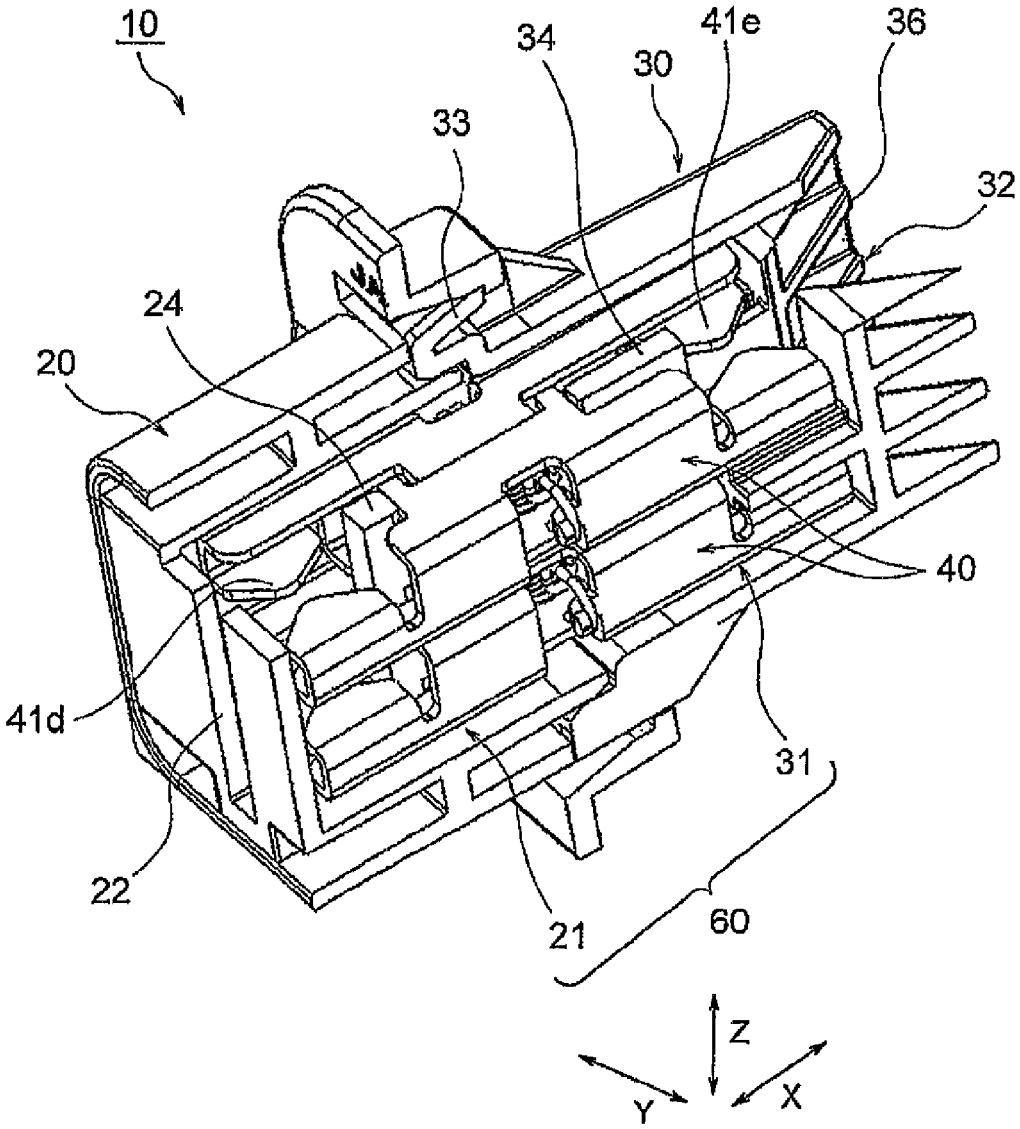
FIG. 8 is an explanatory diagram showing the inside of the connector by cutting the connector.

As shown in FIGS. 6 and 8, the first receiving portion 21 is open on the second housing 30 side and forms the contact receiving portion 60 jointly with a second receiving portion 31 formed in the second housing 30.

Figure 9:
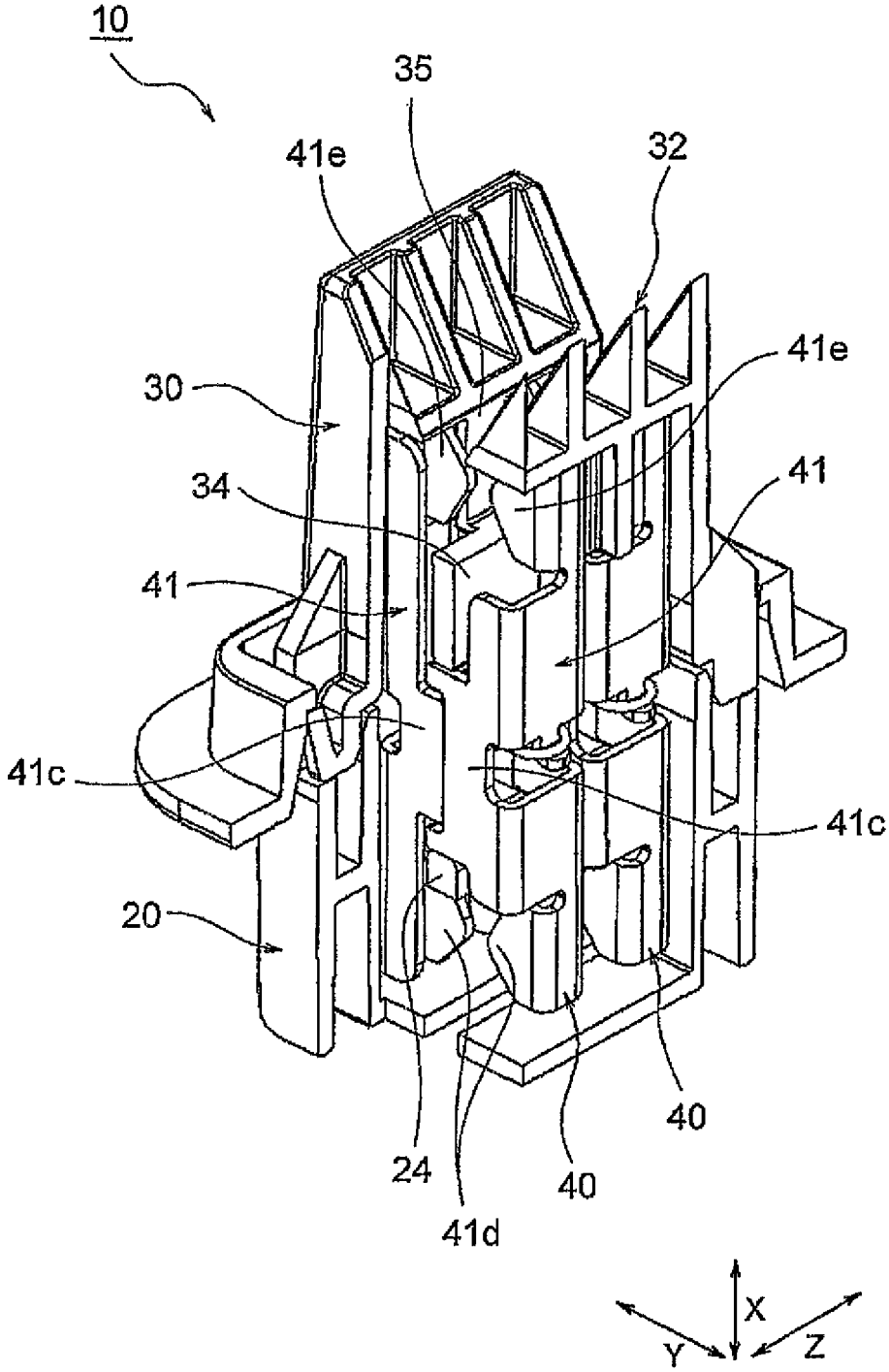
FIG. 9 is an explanatory diagram showing the inside of the connector as seen from an angle different from FIG. 8.
Figure 10:
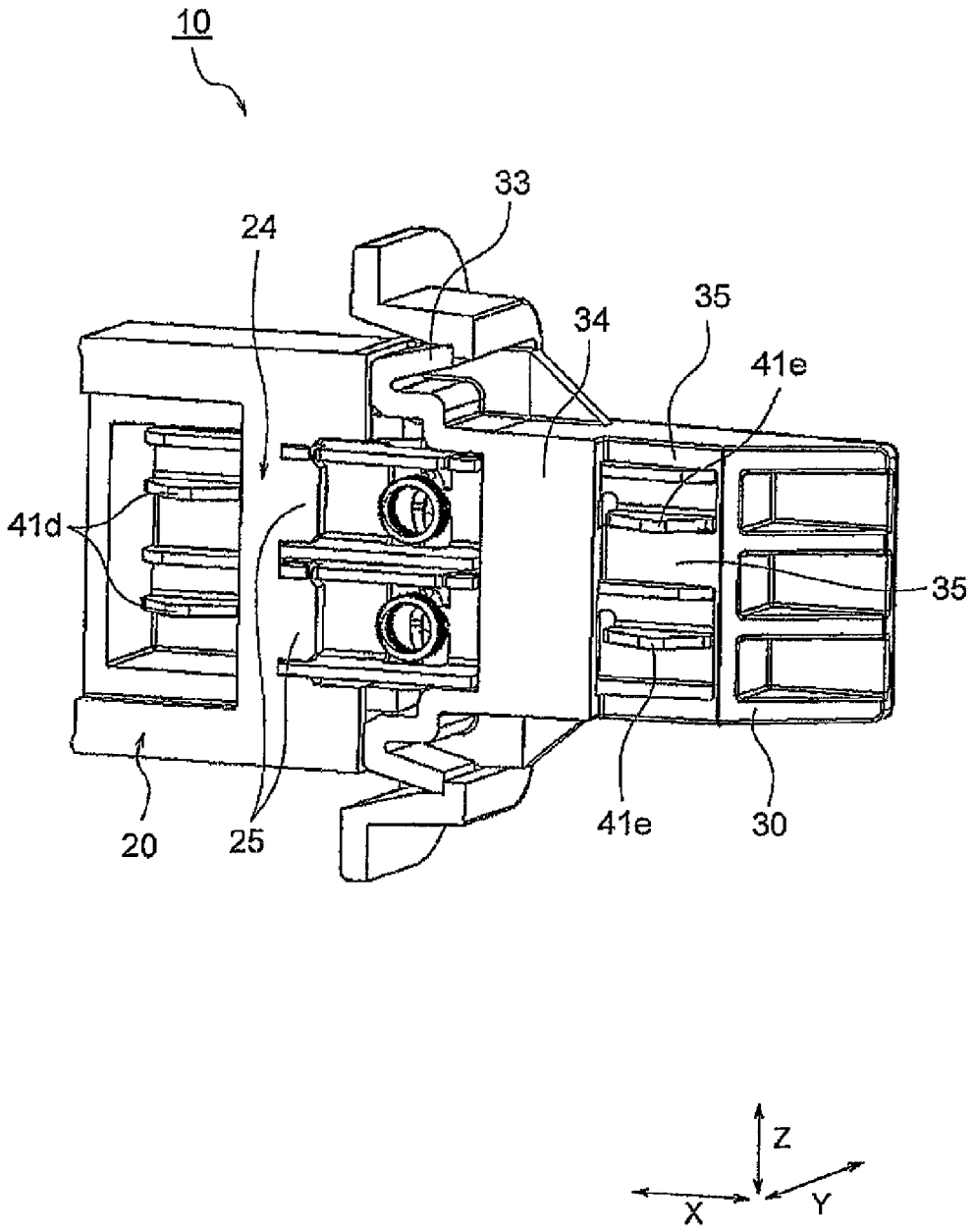
FIG. 10 is an explanatory diagram showing the inside of the connector by cutting the connector at a position different from FIGS. 8 and 9.
Figure 11:
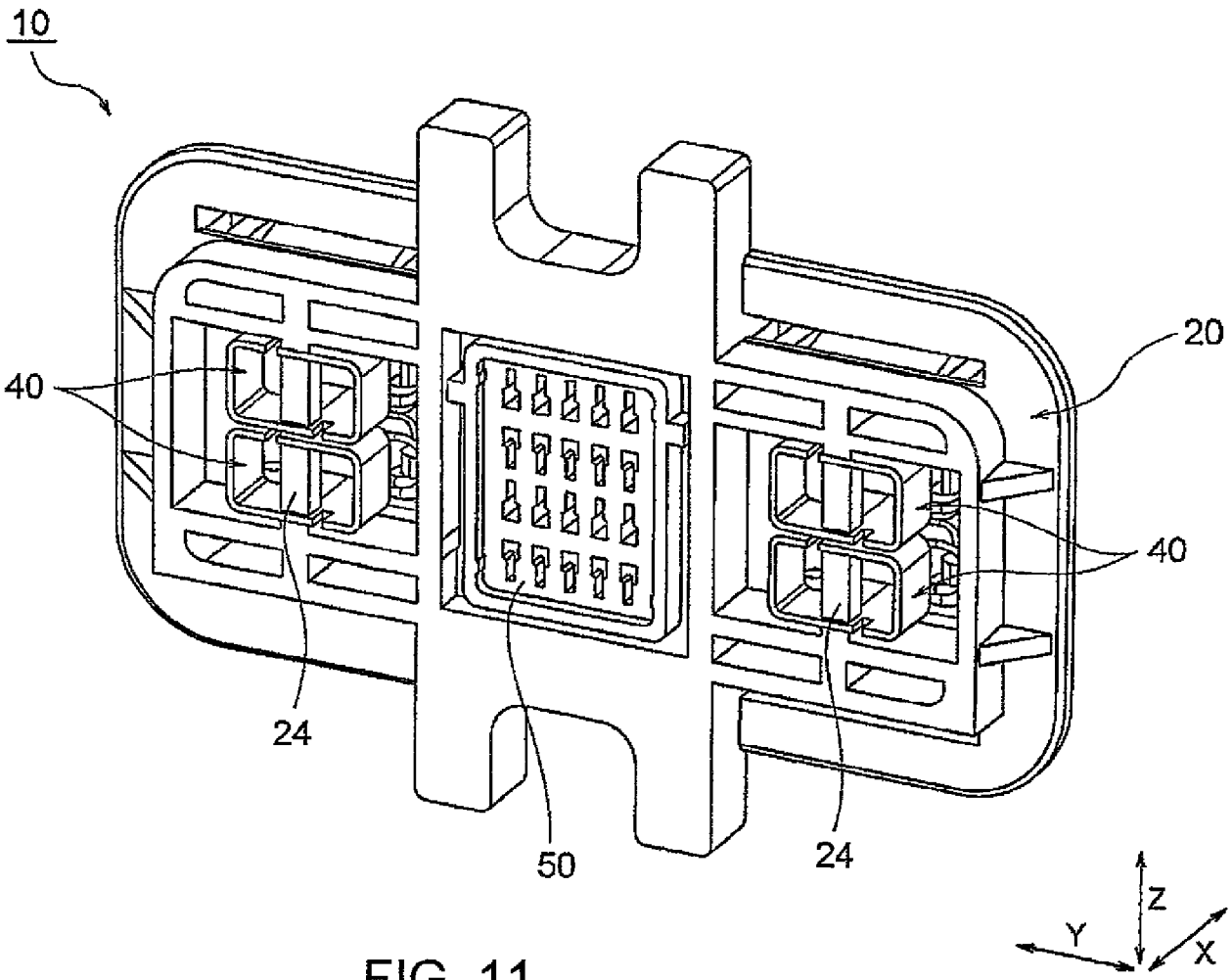
FIG. 11 is an explanatory diagram showing the inside of the connector by cutting the connector at a position different from FIGS. 8 to 10.
Figure 13:
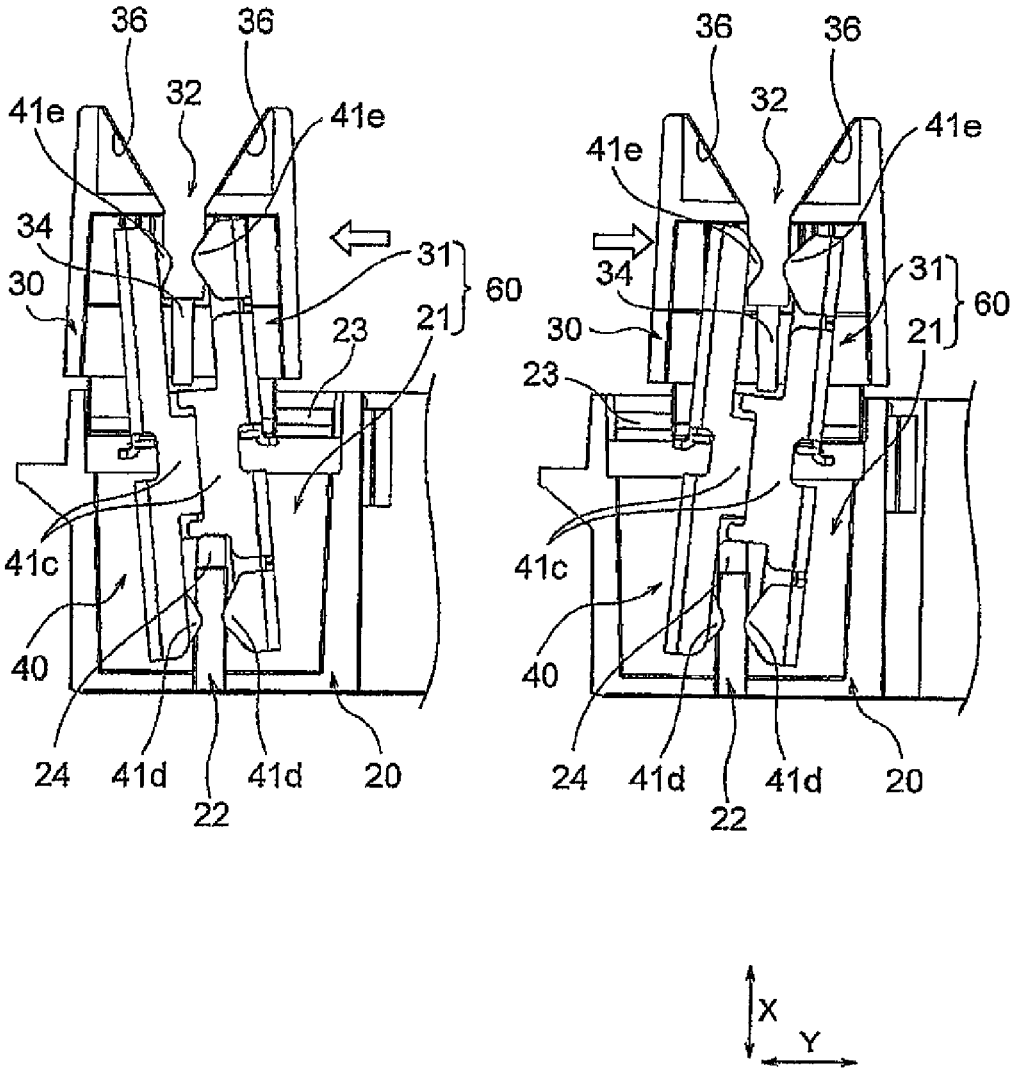
FIG. 13 is an explanatory diagram showing states of sliding a second housing relative to a first housing.

As shown in FIGS. 6 to 11, the first control portion 24 extends in the third direction Z from inner walls, defining the first receiving portion 21, of the first housing 20 toward the inside of the first receiving portion 21 and, as shown in FIGS. 9 and 13, the first control portion 24 is interposed between a pair of conductive members 41 of each contact 40 in a region between support portions 41*c* and first contact portions 41*d* of each contact 40 in the first direction X. Jointly with a second control portion 34 formed in the second housing 30, the first control portion 24 controls the posture (specifically, the posture in the plane defined by the first direction X and the second direction Y) of the contacts 40 in the contact receiving portion 60. More specifically, the first control portion 24 controls the positional relationship between the first opening 22 formed in the first housing 20 and the first contact portions 41*d* so that the rack-side contact 91 inserted from the first opening 22 can enter between the first contact portions 41*d* regardless of the positional relationship between the first housing 20 and the second housing 30. Further, the first control portion 24 serves as a portion that restricts the insertion position (depth of insertion) of the rack-side contact 91 in the first direction X when the rack-side contact 91 is inserted between the first contact portions 41*d*.

The second housing 30 is formed of an insulating resin and attached to the first housing 20 so as to be slidable in the second direction Y relative to the first housing 20.

As shown in FIGS. 6 to 10, the second housing 30 integrally has the second receiving portion 31 receiving part of the contacts 40, a second opening 32 for allowing insertion of the bus bar 73 into the second receiving portion 31, the attaching spring portions 33 attached to the slide guide portions 23 of the first housing 20, the second control portion 34 controlling the position and posture of the contacts 40 in the contact receiving portion 60, a second position restricting portion 35 restricting the position of the contacts 40 in the third direction Z, and guide portions 36 serving to guide the bus bar 73 toward the second opening 32.

As shown in FIG. 8, the second receiving portion 31 is open on the first housing 20 side and forms the contact receiving portion 60 jointly with the first receiving portion 21 formed in the first housing 20.

As shown in FIGS. 8 to 11, the second control portion 34 extends in the third direction Z from inner walls, defining the second receiving portion 31, of the second housing 30 toward the inside of the second receiving portion 31 and, as shown in FIG. 13, the second control portion 34 is interposed between the pair of conductive members 41 of each contact 40 in a region between the support portions 41*c* and second contact portions 41*e* of each contact 40 in the first direction X. Jointly with the first control portion 24 formed in the first housing 20, the second control portion 34 controls the posture (specifically, the posture in the plane defined by the first direction X and the second direction Y) of the contacts 40 in the contact receiving portion 60. More specifically, the second control portion 34 controls the positional relationship between the second opening 32 formed in the second housing 30 and the second contact portions 41*e* so that the bus bar 73 inserted from the second opening 32 can enter between the second contact portions 41*e* regardless of the positional relationship between the first housing 20 and the second housing 30. Further, the second control portion 34 serves as a portion that restricts the insertion position (depth of insertion) of the bus bar 73 in the first direction X when the bus bar 73 is inserted between the second contact portions 41*e*.

The contact 40 is a socket contact for power supply. As shown in FIG. 8, the contacts 40 are arranged in a pair in parallel to each other in the third direction Z in each of the contact receiving portions 60 formed in the connector 10. Each contact 40 is received with play (clearance) with respect to any members including the first housing 20 and the second housing 30. In other words, each contact 40 is not fixed to any members including the first housing 20 and the second housing 30.

Figure 12:
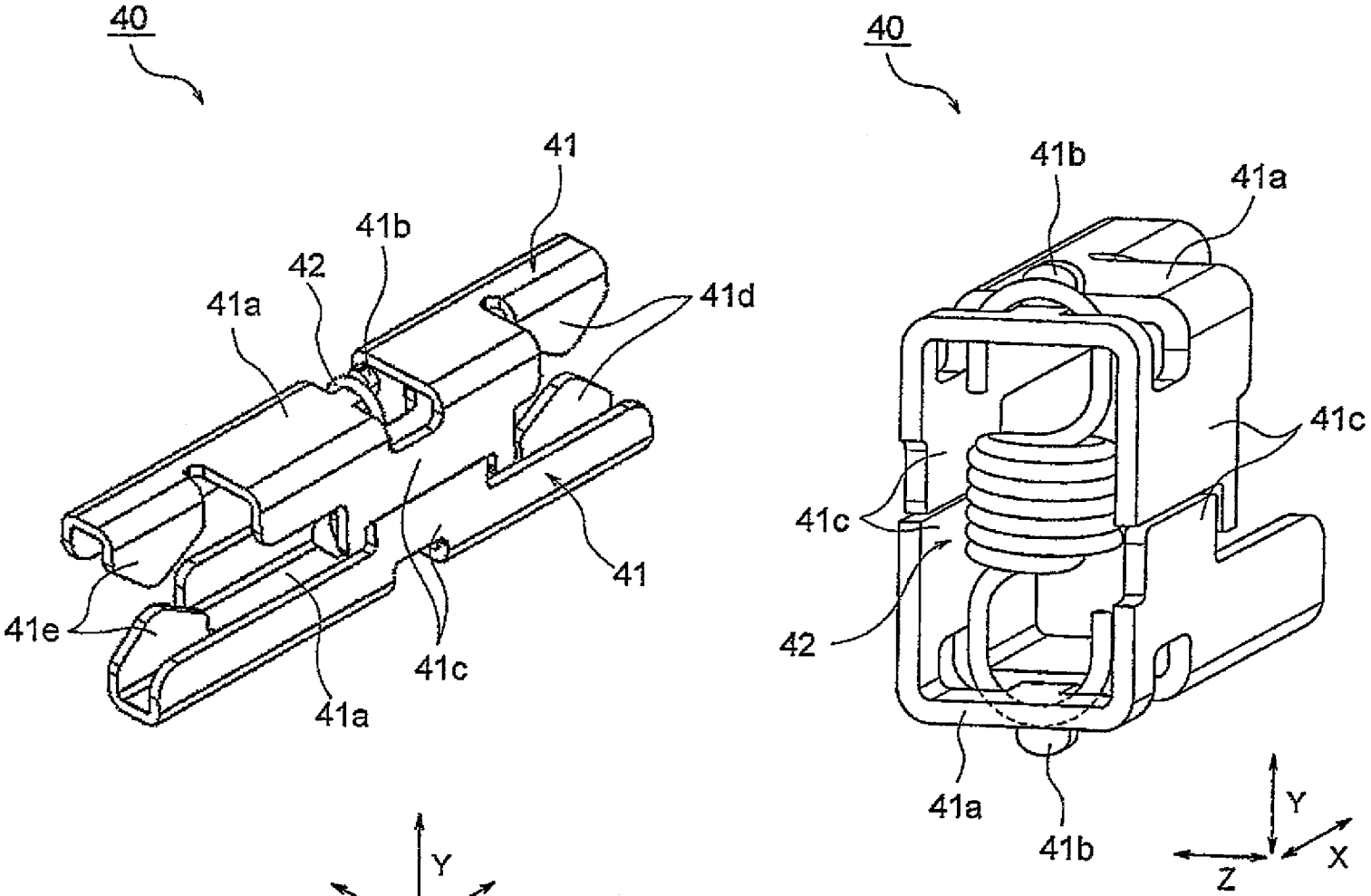
FIG. 12 is an overall perspective view showing a contact and an explanatory diagram showing the contact by cutting it.

As shown in FIG. 12, each contact 40 comprises the pair of conductive members 41 and a biasing member 42 attached between the pair of conductive members 41 and biasing the pair of conductive members 41 in a direction of causing them to approach each other. In this embodiment, as shown in FIG. 12, the biasing member 42 is in the form of a coil spring. However, its specific configuration is not limited thereto and, for example, it may be formed by an elastic member such as a rubber.

The pair of conductive members 41 are formed of an inelastic conductive metal (tough pitch copper, copper with a purity of about 99%) and have the same shape. In this embodiment, each conductive member 41 has a conductivity of 50% or more assuming that the conductivity of pure copper is 100%.

As shown in FIG. 12, the pair of conductive members 41 each have a base portion 41*a* arranged spaced apart from that of the other conductive member 41, an attaching portion 41*b* formed at the base portion 41*a* and attached with the biasing member 42, the support portions 41*c* extending from the base portion 41*a* toward the other conductive member 41 and supporting the other conductive member 41 against a biasing force of the biasing member 42, and the first contact portion 41*d* and the second contact portion 41*e* respectively formed on both sides, in the first direction X, of the attaching portion 41*b* (and the support portion 41*c*).

In this embodiment, as shown in FIG. 12, the support portions 41*c* respectively extend along the second direction Y from both sides, in the third direction Z, of the base portion 41*a* and engage with the support portions 41*c* of the other conductive member 41 so that the positions of this and other conductive members 41 are restricted to each other in the first direction X.

As shown in FIG. 12, each contact 40 is configured such that, in the state where the biasing member 42 is attached to the pair of conductive members 41 to thereby engage the support portions 41*c* of the pair of conductive members 41 with each other, the three-dimensional structure after the assembly is autonomously maintained.

Each contact 40 is disposed in the state where the first contact portions 41*d* face each other in the second direction Y and the second contact portions 41*e* face each other in the second direction Y, so as to be connected to the rack-side contact 91 by holding the rack-side contact 91 between the first contact portions 41*d* disposed in the first receiving portion 21 and to be connected to the bus bar 73 by holding the bus bar 73 between the second contact portions 41*e* disposed in the second receiving portion 31.

As described before, the position and posture (specifically, the position and posture in the plane defined by the first direction X and the second direction Y) of the contacts 40 in the contact receiving portion 60 are controlled by the first control portion 24 formed in the first housing 20 and the second control portion 34 formed in the second housing 30 while the position of the contacts 40 in the third direction Z in the contact receiving portion 60 is controlled by the first position restricting portion 25 formed in the first housing 20 and the second position restricting portion 35 formed in the second housing 30.

As shown in FIG. 12, the biasing member 42 is attached between the attaching portions 41*b* respectively formed in the pair of conductive members 41 and is disposed in a space defined by the base portions 41*a* and the support portions 41*c* respectively formed in the pair of conductive members 41 forming the contact 40.

Next, referring mainly to FIG. 6, an assembly method of the connector 10 will be described.

First, the contacts 40 are inserted into each of the first receiving portions 21 of the first housing 20.

Herein, the distance between the first contact portions 41*d* facing in the second direction Y is set shorter than the width (width in the second direction Y) of the first control portion 24 formed in the first housing 20. Consequently, when each contact 40 is inserted into the first housing 20, the distance between the first contact portions 41*d* is once increased by the first control portion 24. Then, when the contact 40 is further inserted, the first contact portions 41*d* ride over the first control portion 24 so that the distance between the first contact portions 41*d* returns to the initial distance. Accordingly, the contact 40 is prevented from coming off in the first direction X by the first control portion 24.

In this manner, the attachment of the contact 40 to the first housing 20 is achieved by the single operation of inserting the contact 40 into the first receiving portion 21.

Then, the second housings 30 are each inserted into the first housing 20 with the attaching spring portion 33 side at the head.

In this event, the attaching spring portions 33 are brought into contact with the first housing 20 so as to be once elastically deformed. Then, when the attaching spring portions 33 are further inserted into the first housing 20, the attaching spring portions 33 are elastically restored to engage with the slide guide portions 23 of the first housing 20 so that the second housing 30 is prevented from coming off the first housing 20.

Herein, the distance between the second contact portions 41*e* facing in the second direction Y is set equal to or greater than the width (width in the second direction Y) of the second control portion 34. Consequently, when the second housing 30 is inserted into the first housing 20, the second contact portions 41*e* do not engage with the second control portion 34 so that the second housing 30 can be smoothly inserted into the first housing 20.

In this manner, the attachment of the second housing 30 to the first housing 20 is achieved by the single operation of inserting the second housing 30 into the first housing 20.

Like the first control portion 24, the width of the second control portion 34 may be set greater than the distance between the second contact portions 41*e*.

Figure 14:
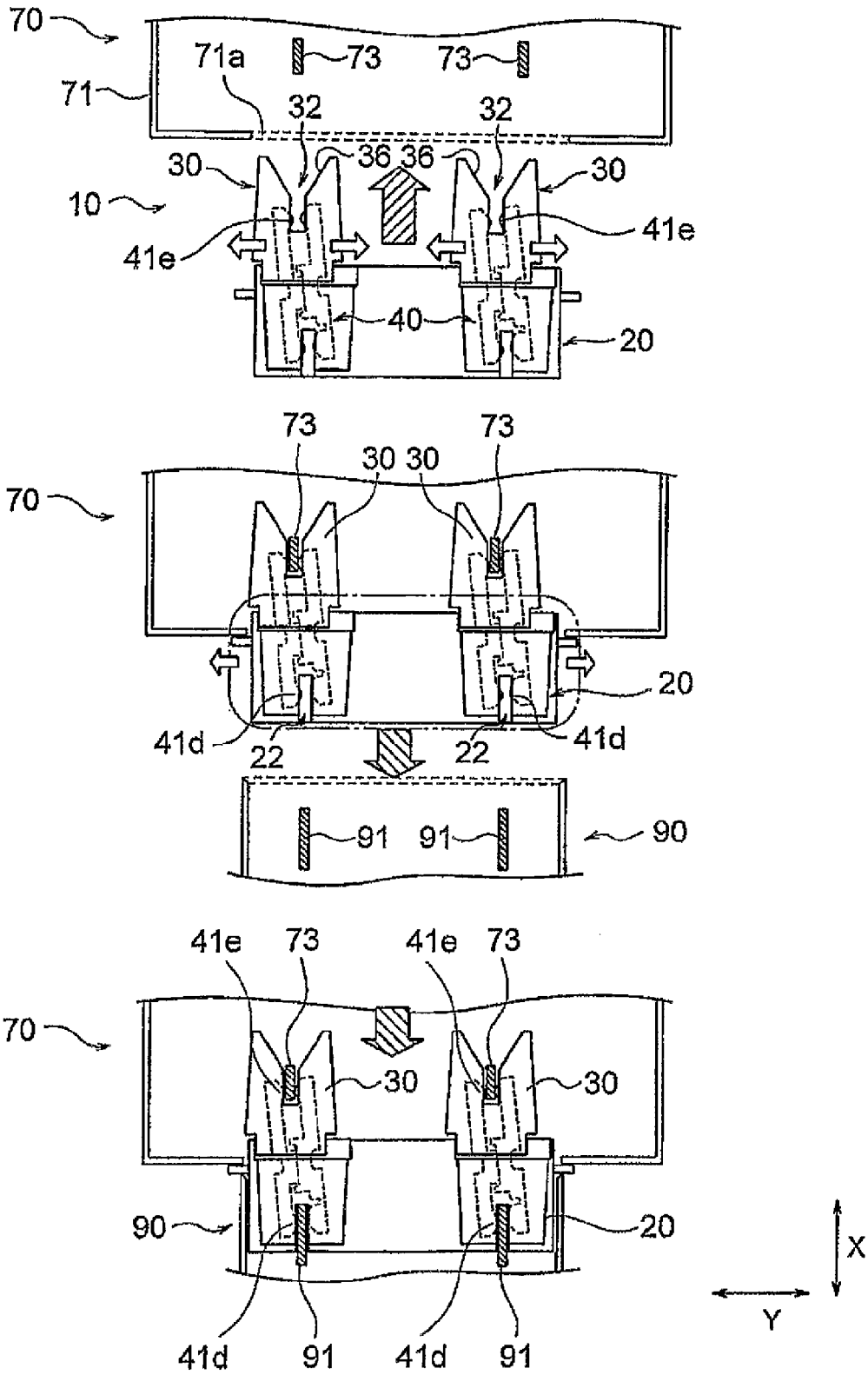
FIG. 14 is an explanatory diagram conceptually showing states when the connector is attached to the battery unit and when the connector is attached to the rack-side connector.
Figure 15:
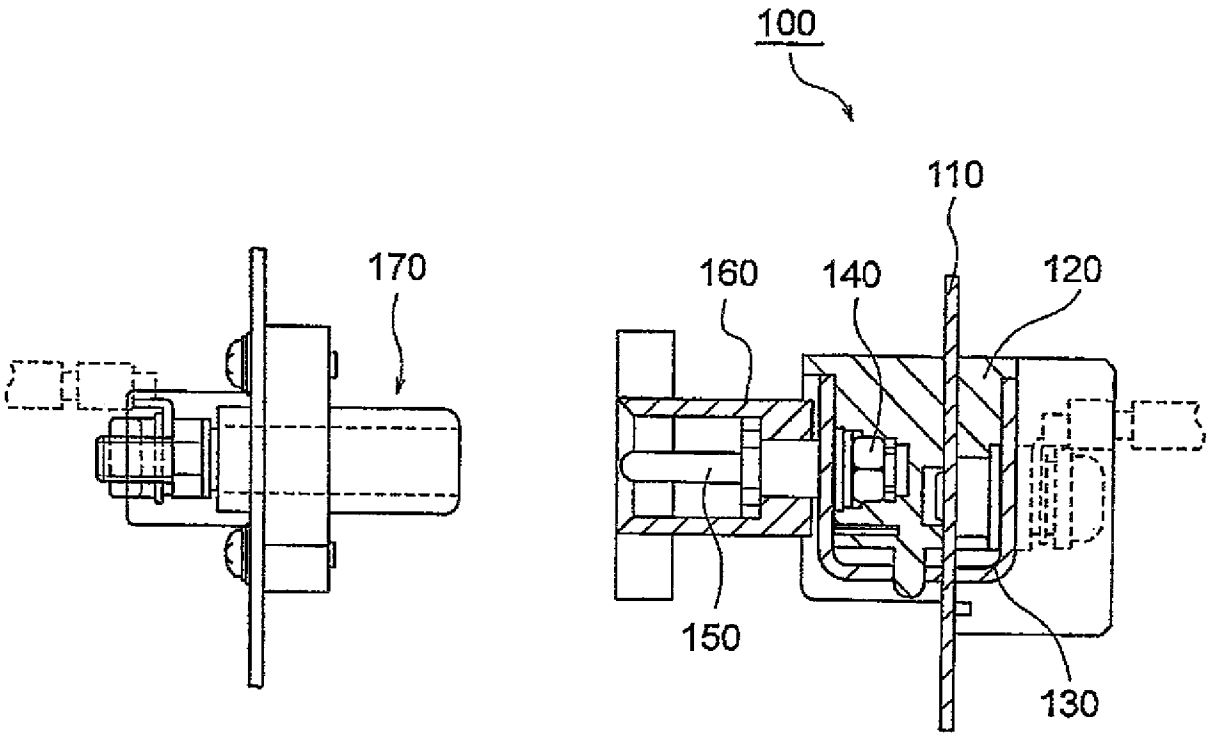
FIG. 15 is an explanatory diagram showing conventional plug-in connectors.

Next, referring mainly to FIG. 14, a method of attaching the connector 10 to the battery unit 70 will be described hereinbelow.

First, with the second housing 30 side at the head, the connector 10 is inserted into the attaching opening 71*a* formed in the casing 71, and then the bus bars 73 are each inserted between the second contact portions 41*e*.

In this event, since each second housing 30 is attached to the first housing 20 so as to be slidable in the second direction Y relative to the first housing 20, the position of the second housing 30 in the second direction Y is corrected by contact between the bus bar 73 and the guide portions 36 of the second housing 30.

Then, with this sliding of the second housing 30, the contacts 40 are pushed in the second direction Y by the second control portion 34 formed in the second housing 30 so that the position of the second contact portions 41*e* is also corrected in the second direction Y.

In this event, when the bus bar 73 inserted into the connector 10 abuts against the second control portion 34, the insertion position (insertion depth) of the bus bar 73 in the first direction X is restricted by the second control portion 34.

Then, the first housing 20 is attached to the casing 71 using the spacers 74 and the bolts 75.

In this state where the connector 10 is attached to the battery unit 70, since the bus bars 73 fixed to the casing 71 are each held between the second contact portions 41*e*, the positional relationship between the second contact portions 41*e* (or the second housings 30) and the bus bars 73 (or the casing 71) is almost fixed. On the other hand, in this embodiment, since the first housing 20 is provided so as to be slidable in the second direction Y relative to the second housings 30 and the casing 71, the first housing 20 can freely move in the second direction Y relative to the casing 71.

Next, referring mainly to FIG. 14, a method of attaching the battery unit 70 to the receiving rack 80 will be described hereinbelow.

First, with the connector 10 side at the head, the battery unit 70 with the connector 10 is inserted into the receiving rack 80 so that the rack-side contacts 91 are each inserted between the first contact portions 41*d*.

Figure 4:
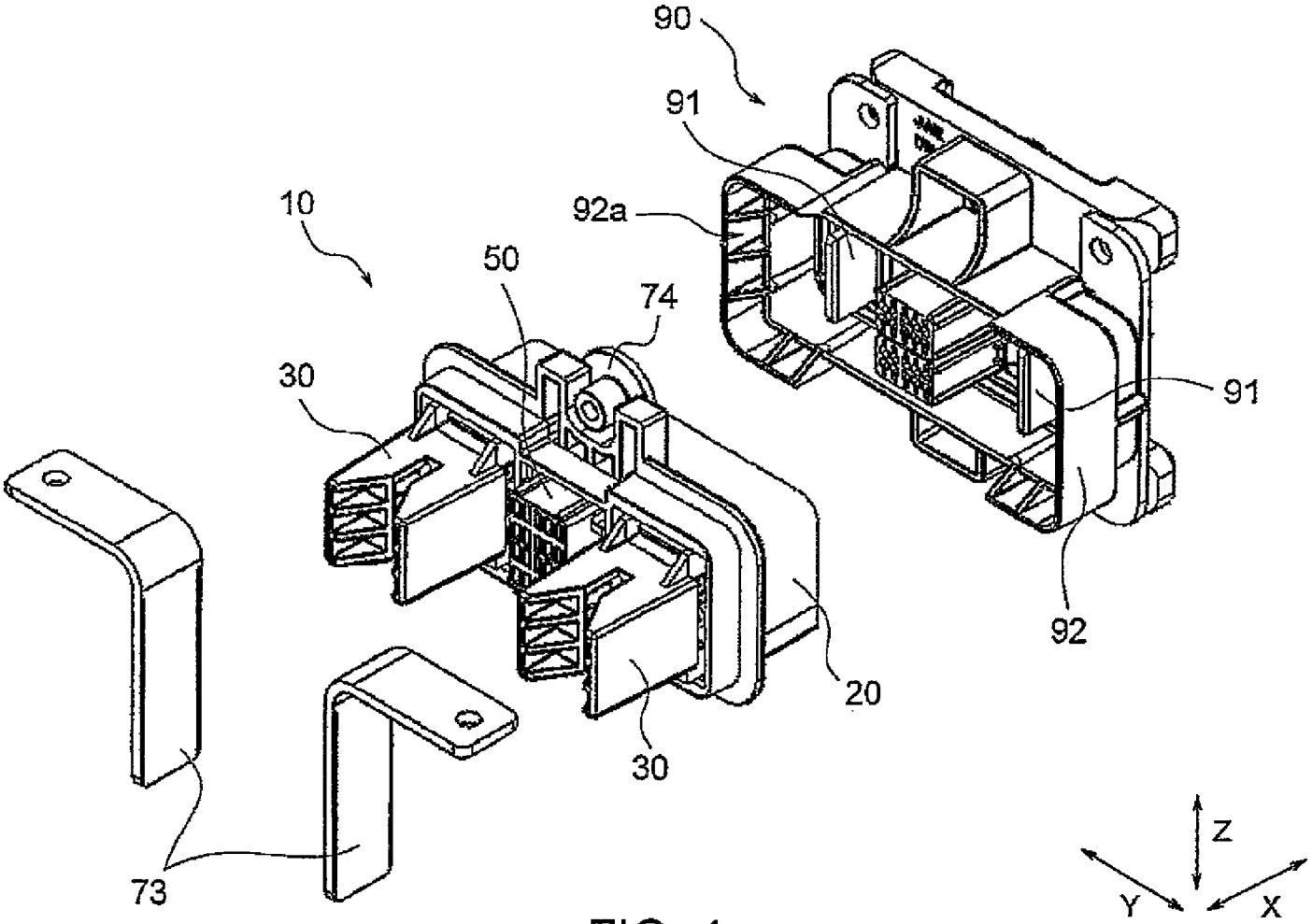
FIG. 4 is a perspective view showing bus bars, the connector, and a rack-side connector.
Figure 5:
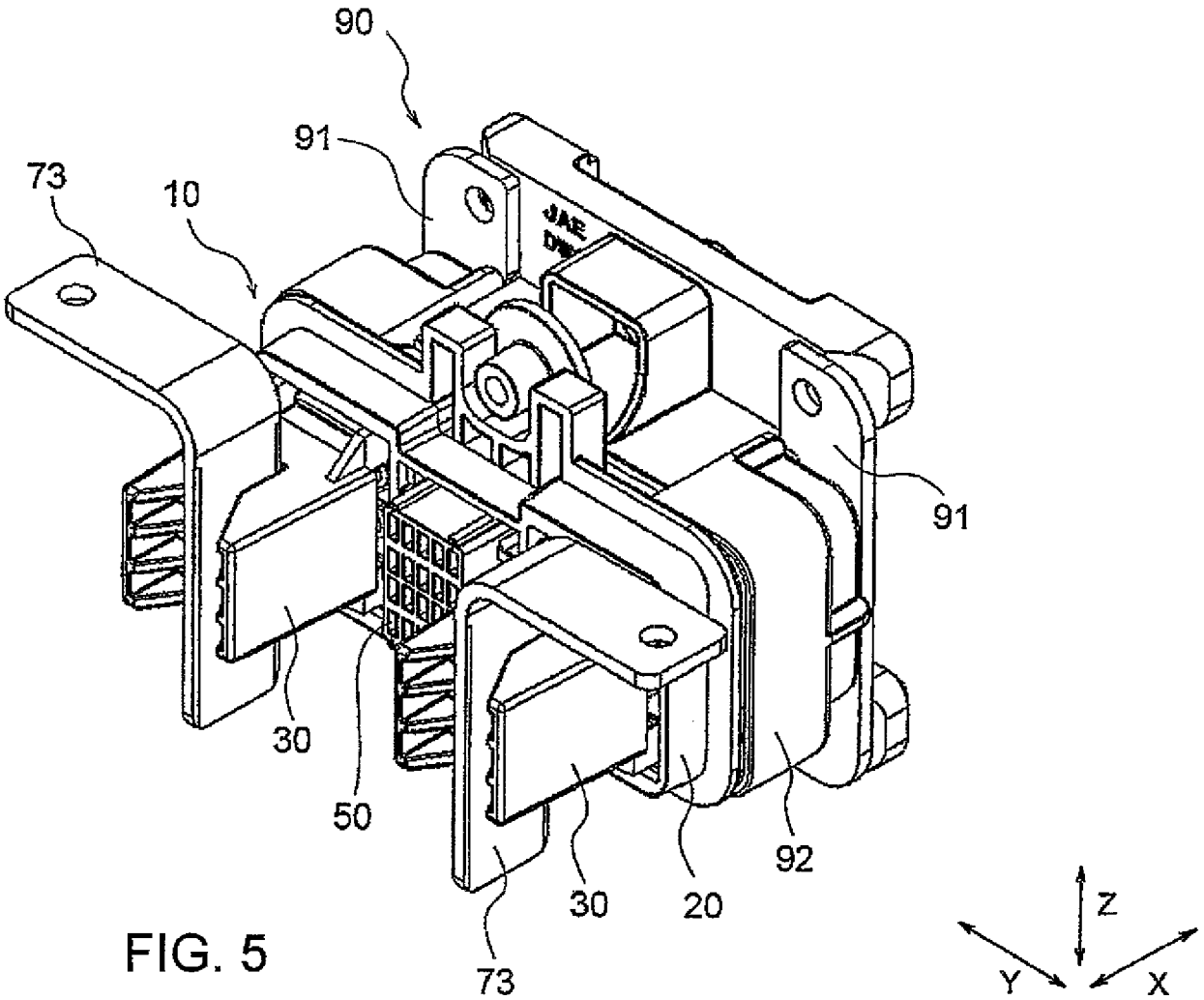
FIG. 5 is a perspective view showing a state where the bus bars, the connector, and the rack-side connector are fitted together.

In this event, since, as shown in FIG. 4, a rack-side housing 92 of the rack-side connector 90 is formed with guide portions 92*a* serving to guide the connector 10 in the second direction Y and since the first housing 20 is attached to the casing 71 so as to be movable in the second direction Y relative to the casing 71, the first housing 20 is pushed in the second direction Y by the guide portions 92*a* so that the first housing 20 slides relative to the battery unit 70 to be corrected in position in the second direction Y.

In this embodiment, as described above, the guide portions 92*a* are formed in the rack-side housing 92. Conversely, guide portions serving to correct the positional relationship in the second direction Y between the first housing 20 and the rack-side housing 92 may be formed on the first housing 20 side.

Then, with this sliding of the first housing 20 relative to the battery unit 70, the contacts 40 are pushed in the second direction Y by each of the first control portions 24 formed in the first housing 20 so that the position of the first contact portions 41*d* is also corrected in the second direction Y.

In this event, when each rack-side contact 91 inserted into the connector 10 abuts against the first control portion 24, the insertion position of the rack-side contact 91 in the first direction X is restricted by the first control portion 24.

In the connector 10 of this embodiment thus obtained, since the second housing 30 is slidably attached to the first housing 20 and the contact 40 is disposed with play in the contact receiving portion 60 formed by the first housing 20 and the second housing 30, it is possible to displace the second contact portions 41*e* of the contact 40 by the second control portion 34 following the sliding movement of the second housing 30. Therefore, it is possible to ensure a large floating amount (displacement amount) of the contact 40 with the simple structure and thus to improve the reliability of connection between the second contact portions 41*e* and the bus bar 73 by allowing a position offset in the second direction Y between the second contact portions 41*e* and the bus bar 73.

Further, since the first housing 20 is slidably attached to the second housing 30 and, in addition, is attached to the casing 71 so as to be movable in the second direction Y relative to the casing 71, even if the connector 10 is attached to the battery unit 70 so that the positional relationship between the bus bar 73 and the second contact portions 41*e* is almost fixed, the movability of the first housing 20 relative to the casing 71 of the battery unit 70 can be maintained. Therefore, it is possible to improve the reliability of connection between the first contact portions 41*d* and the rack-side contact 91 by allowing a position offset in the second direction Y between the first contact portions 41*d* and the rack-side contact 91.

Further, since the contact 40 is received with play in the contact receiving portion 60 formed by the first housing 20 and the second housing 30, no additional component, such as an attaching member, is required for attaching the contact 40 to the first housing 20 and the second housing 30. Therefore, the number of components is small and thus the workload for assembly can be reduced.

Since the first control portion 24 that controls the position and posture of the contact 40 in the first receiving portion 21 is disposed between the conductive members 41, even when the first housing 20 slides in either direction as the second direction Y, the position and posture of the contact 40 on the first contact portion 41*d* side can be controlled only by the first control portion 24 regardless of design of the inner walls, defining the first receiving portion 21 and located around the contact 40, of the first housing 20. Therefore, the degree of design freedom of the first housing 20 can be improved.

Likewise, since the second control portion 34 that controls the position and posture of the contact 40 in the second receiving portion 31 is disposed between the conductive members 41, even when the second housing 30 slides in either direction as the second direction Y, the position and posture of the contact 40 on the second contact portion 41*e* side can be controlled only by the second control portion 34 regardless of design of the inner walls, defining the second receiving portion 31 and located around the contact 40, of the second housing 30. Therefore, the degree of design freedom of the second housing 30 can be improved.

Further, since the first control portion 24 is disposed between the conductive members 41, the first control portion 24 serves also as the portion that restricts the insertion position of the rack-side contact 91 in the first direction X when the rack-side contact 91 is inserted into the connector 10. Consequently, it is not necessary to form a portion, separately from the first control portion 24, that restricts the insertion position of the rack-side contact 91. Therefore, the degree of design freedom of the first housing 20 can be further improved.

Likewise, since the second control portion 34 is disposed between the conductive members 41, the second control portion 34 serves also as the portion that restricts the insertion position of the bus bar 73 in the first direction X when the bus bar 73 is inserted into the connector 10. Consequently, it is not necessary to form a portion, separately from the second control portion 34, that restricts the insertion position of the bus bar 73. Therefore, the degree of design freedom of the second housing 30 can be further improved.

In the above-mentioned embodiment, the description has been given assuming that a connector is a connector to which two different connection objects are fitted from the outside. However, a specific configuration of a connector is not limited thereto. For example, it may be configured such that a single connection object is fitted to a connector from the outside.

In the above-mentioned embodiment, the description has been given assuming that a contact has a first contact portion for contact with one connection object and a second contact portion for contact with another connection object. However, in the case where a single connection object is fitted from the outside, a contact may be formed with only one contact portion.

In the above-mentioned embodiment, the description has been given assuming that a first housing and a second housing each have a control portion that controls the position and posture of a contact in a contact receiving portion. However, the control portion may be provided in only one of the housings.

In the above-mentioned embodiment, the description has been given assuming that a first housing is movably attached to an attaching object. However, the first housing may be fixed to the attaching object.

In the above-mentioned embodiment, a contact comprises a pair of conductive members and a biasing member and is configured to contact with a connection object by holding the connection object between the pair of conductive members. However, a specific configuration of a contact is not limited thereto. For example, a contact may be formed by a single conductive member.

In the above-mentioned embodiment, the description has been given assuming that a contact is entirely received in a contact receiving portion. However, the contact may partially protrude to the outside of the contact receiving portion.

In the above-mentioned embodiment, the description has been given assuming that a contact is a contact for power supply. However, it may be used as a signal contact.

DESCRIPTION OF SYMBOLS

10 connector
20 first housing
21 first receiving portion
22 first opening
23 slide guide portion
24 first control portion
25 first position restricting portion
26 signal housing holding portion
30 second housing
31 second receiving portion
32 second opening
33 attaching spring portion
34 second control portion
35 second position restricting portion
36 guide portion
40 contact
41 conductive member
41*a* base portion
41*b* attaching portion
41*c* support portion
41*d* first contact portion
41*e* second contact portion
42 biasing member
50 signal housing
51 signal line
60 contact receiving portion
70 battery unit
71 casing (attaching object)
71*a* attaching opening
72 battery
73 bus bar (connection object)
74 spacer
75 bolt
80 receiving rack
90 rack-side connector
91 rack-side contact (another connection object)
92 rack-side housing
92*a* guide portion
X first direction
Y second direction
Z third direction

The invention claimed is:

1. A connector comprising:

a first housing, a second housing attached to the first housing and forming a contact receiving portion jointly with the first housing, and a contact at least partially received in the contact receiving portion, wherein the second housing is attached to the first housing so as to be movable in a predetermined direction relative to the first housing, wherein the contact is received in the contact receiving portion in a state where the contact is not fixed to the first housing or the second housing so as to be movable relative to the first housing and the second housing, and wherein the second housing comprises a second control portion that controls a position and posture of the contact in the contact receiving portion and that pushes the contact when the first housing and the second housing move relative to each other.

2. The connector according to claim 1, wherein the contact comprises a second contact portion disposed on the second housing side and adapted to contact with a connection object.

3. The connector according to claim 2, wherein the contact further comprises a first contact portion disposed on the first housing side and adapted to contact with another connection object.

4. The connector according to claim 1, wherein the first housing comprises a first control portion that controls a position and posture of the contact in the contact receiving portion and that pushes the contact when the first housing and the second housing move relative to each other.

5. The connector according to claim 2, wherein the contact comprises:

a pair of conductive members facing each other, and a biasing member provided between the pair of conductive members and biasing the pair of conductive members in a direction of causing them to approach each other, and wherein the contact is adapted to hold the connection object between the pair of conductive members biased by the biasing member.

6. The connector according to claim 3, wherein the contact comprises:

a pair of conductive members facing each other, and a biasing member provided between the pair of conductive members and biasing the pair of conductive members in a direction of causing them to approach each other, and wherein the contact is adapted to hold the another connection object between the pair of conductive members biased by the biasing member.

7. The connector according to claim 1, wherein the second housing comprises a second position restricting portion that restricts a position of the contact in a direction perpendicular to a direction of fitting to the connection object and to a direction in which the first housing relatively moves.

8. The connector according to claim 1, wherein the first housing comprises a first position restricting portion that restricts a position of the contact in a direction perpendicular to a direction of fitting to the connection object and to a direction in which the second housing relatively moves.

9. The connector according to claim 1, wherein the second housing is attached to the first housing so as to be movable relative to the first housing in a direction perpendicular to a direction of fitting to the connection object.

10. A connector device comprising:

the connector according to claim 1 and an attaching object to which the connector is attached, wherein the first housing is attached to the attaching object so as to be movable relative to the attaching object.

11. A battery unit comprising:

the connector according to claim 1, an attaching object to which the connector is attached, and the connection object, wherein the connection object is a bus bar.

12. The battery unit according to claim 11, further comprising another bus bar, wherein the bus bar is connected to the other bus bar and to the contact of the connector.

13. The battery unit according to claim 11, wherein the bus bar comprises a bent shape.

14. A connector comprising:

a first housing, a second housing attached to the first housing and forming a contact receiving portion jointly with the first housing, and a contact at least partially received in the contact receiving portion, wherein the second housing is attached to the first housing so as to be movable in a predetermined direction relative to the first housing, wherein the contact is received in the contact receiving portion in a state where the contact is not fixed to the first housing or the second housing so as to be movable relative to the first housing and the second housing, and wherein the first housing comprises a first control portion that controls a position and posture of the contact in the contact receiving portion and that pushes the contact when the first housing and the second housing move relative to each other.

15. A connector comprising:

a first housing, a second housing attached to the first housing and forming a contact receiving portion jointly with the first housing, and a contact at least partially received in the contact receiving portion, wherein the second housing is attached to the first housing so as to be movable in a predetermined direction relative to the first housing, wherein the contact is received in the contact receiving portion in a state where the contact is not fixed to the first housing or the second housing so as to be movable relative to the first housing and the second housing, and wherein the contact comprises:

a pair of conductive members facing each other, and a biasing member provided between the pair of conductive members and biasing the pair of conductive members in a direction of causing them to approach each other, and wherein the contact is adapted to hold a connection object between the pair of conductive members biased by the biasing member.

16. The connector according to claim 15, wherein a second control portion of the second housing is interposed between the pair of conductive members.

17. A connector comprising:

a first housing, a second housing attached to the first housing and forming a contact receiving portion jointly with the first housing, and a contact at least partially received in the contact receiving portion, wherein the second housing is attached to the first housing so as to be movable in a predetermined direction relative to the first housing, wherein the contact is received in the contact receiving portion in a state where the contact is not fixed to the first housing or the second housing so as to be movable relative to the first housing and the second housing, wherein the contact comprises a second contact portion disposed on the second housing side and adapted to contact with a connection object, wherein the contact further comprises a first contact portion disposed on the first housing side and adapted to contact with another connection object, wherein the contact further comprises:

a pair of conductive members facing each other, and a biasing member provided between the pair of conductive members and biasing the pair of conductive members in a direction of causing them to approach each other, and wherein the contact is adapted to hold the another connection object between the pair of conductive members biased by the biasing member.

18. The connector according to claim 17, wherein a first control portion of the first housing is interposed between the pair of conductive members.

* * * * *